US008043058B1

(12) United States Patent
Liang

(10) Patent No.: US 8,043,058 B1
(45) Date of Patent: Oct. 25, 2011

(54) TURBINE BLADE WITH CURVED TIP COOLING HOLES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 722 days.

(21) Appl. No.: 12/195,695

(22) Filed: Aug. 21, 2008

(51) Int. Cl.
*F01D 5/18* (2006.01)

(52) U.S. Cl. ..... 416/97 R; 415/173.1

(58) Field of Classification Search ..... 416/92, 416/96 R, 97 R, 228; 415/173.1
See application file for complete search history.

(56) References Cited

U.S. PATENT DOCUMENTS 5,192,192 A * 3/1993 Ourhaan ..... 416/97 R
5,403,158 A * 4/1995 Auxier ..... 416/97 R
6,994,514 B2 * 2/2006 Soechting et al. ..... 415/115

* cited by examiner

*Primary Examiner* — Matthew W Such
*Assistant Examiner* — Ali Naraghi
(74) *Attorney, Agent, or Firm* — John Ryznic

(57) ABSTRACT

A turbine blade with single tip rail located on the suction side of the tip, and a plurality of curved diffusion holes to discharge cooling air onto the pressure side wall and the tip floor or tip corner of the blade to provide cooling and to limit leakage of the hot gas flow through the tip gap. The curved diffusion holes are curved in an upward direction toward the tip, and each includes a metering hole with an inlet axis normal to the cooling supply cavity surface. A suction side tip rail is flush with the backside wall and slants outward toward the front edge on the inner side. A first curved diffusion hole opens onto the pressure side wall just below the tip corner, a second curved diffusion hole opens adjacent to the tip corner, and a third curved diffusion holes opens onto the tip floor adjacent to the tip corner and at a midpoint between the tip corner and the tip rail. The second diffusion hole provides a layer of film cooling air to the forward side of the tip corner where the first layer of film cooling air does not come into contact so that the entire tip floor is covered by layers of film cooling air.

16 Claims, 5 Drawing Sheets

TURBINE BLADE WITH CURVED TIP COOLING HOLES

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine blade with tip cooling.

2. Description of the Related Art Including Information Disclosed Under 37 CFR 1.97 and 1.98

In a gas turbine engine, especially an industrial gas turbine, engine, the turbine includes several stages of turbine blades that rotate within a shroud that forms a small gap between the rotating blade tip and the stationary shroud. The hot gas that flows through the turbine blades can also leak through this small gap as the hot gas flows leaks across the blade tip from the pressure side to the suction side. The blade tip region is difficult to properly cool which creates hot spots on section of the blade tip that eventually erode or corrode away. Engine performance and blade tip life can be increased by minimizing the gap so that less hot gas flow leakage occurs, and adequately cool the blade tip section. The blade tips are also subject to rub against the inner surface of the shroud that forms the blade outer air seal (BOAS). Blade tips include one or more tip rails to minimize the gap leakage and surface area of the tip crown that rubs.

High temperature turbine blade tip section heat load is a function of the blade tip leakage flow. A high leakage flow will induce a high heat load onto the blade tip section. Thus, blade tip section sealing and cooling have to be addressed as a single problem. A prior art turbine blade tip design is shown in FIGS. 1-3 and includes a squealer tip rail that extends around the perimeter of the airfoil flush with the airfoil wall to form an inner squealer pocket. The main purpose of incorporating the squealer tip in a blade design is to reduce the blade tip leakage and also to provide for improved rubbing capability for the blade. The narrow tip rail provides for a small surface area to rub up against the inner surface of the shroud that forms the tip gap. Thus, less friction and less heat are developed when the tip rubs.

Traditionally, blade tip cooling is accomplished by drilling holes into the upper extremes of the serpentine coolant passages formed within the body of the blade from both the pressure and suction surfaces near the blade tip edge and the top surface of the squealer cavity. In general, film cooling holes are built in along the airfoil pressure side and suction side tip sections and extend from the leading edge to the trailing edge to provide edge cooling for the blade squealer tip. Also, convective cooling holes also built in along the tip rail at the inner portion of the squealer pocket provide additional cooling for the squealer tip rail. Since the blade tip region is subject to severe secondary flow field, this requires a large number of film cooling holes that requires more cooling flow for cooling the blade tip periphery. FIG. 1 shows the prior art squealer tip cooling arrangement and the secondary hot gas flow migration around the blade tip section. FIG. 2 shows a profile view of the pressure side and FIG. 3 shows the suction side each with tip peripheral cooling holes for the prior art turbine blade of FIG. 1.

The blade squealer tip rail is subject to heating from three exposed side: 1) heat load from the airfoil hot gas side surface of the tip rail, 2) heat load from the top portion of the tip rail, and 3) heat load from the back side of the tip rail. Cooling of the squealer tip rail by means of discharge row of film cooling holes along the blade pressure side and suction peripheral and conduction through the base region of the squealer pocket becomes insufficient. This is primarily due to the combination of squealer pocket geometry and the interaction of hot gas secondary flow-mixing. The effectiveness induced by the pressure film cooling and tip section convective cooling holes become very limited. In addition, a TBC is normally used on an industrial gas turbine (IGT) airfoil for the reduction of blade metal temperature. However, applying the TBC around the blade tip rail without effective backside convective cooling may not reduce the blade tip rail metal temperature. FIG. 4 shows the state of the art turbine blade tip cooling design of the prior art.

One location on the blade tip that is difficult to adequately cool is the tip corner on the pressure or upstream side of the blade. Film cooling holes are used to discharge a layer of film cooling air onto the pressure side wall just below the tip corner as disclosed in U.S. Pat. No. 7,192,250 B2 issued to Boury et al. on Mar. 20, 2007 and entitled HOOLOW ROTOR BLADE FOR THE FUTURE OF A GAS TURBINE ENGINE, which shows a film cooling hole angled upward toward the tip, corner formed with a pressure side tip rail. The layer of film cooling air flows up and over the top or crown of the pressure side tip rail. The layer of cooling air does not touch the tip crown. Also, because of the presence of the pressure side tip rail, the cooling air flows over the forward side of the tip pocket formed between the pressure side tip rail and the suction side tip rail.

U.S. Pat. No. 7,029,235 B2 issued to Liang on Apr. 18, 2006 and entitled COOLING SYSTEM FOR A TIP OF A TURBINE BLADE discloses a blade with pressure side wall having a film cooling hole to discharge cooling air upward toward the blade tip, the blade tip having a flat crown with a tip cooling hole to discharge cooling air out from the tip crown in a direction straight up. The problem with this tip cooling design is that the cooling hole on the tip will push the layer of cooling air from the pressure side of the blade over the tip crown so that no cooling air reaches the tip surface to provide cooling. The only cooling occurring to the tip is convective cooling due to the cooling air passing through the hole formed within the tip itself.

U.S. Pat. No. 7,351,035 B2 issued to Deschamps et al. on Apr. 1, 2008 and entitled HOLLOW ROTOR BLADE FOR THE TURBINE OF A GAS TURBINE ENGINE, THE BLADE BEING FITTED WITH A "BATHTUB" discloses a blade tip with single tip rail on the suction side, a flat tip crown, and a front tip corner angled toward the oncoming hot gas flow. A cooling hole is formed in the tip corner and angled toward the oncoming hot gas flow and a tip floor or crown cooling hole to discharge cooling air up and into the area above the tip floor upstream from the tip rail. The problem with this design is that the pressure side wall of the tip corner is not cooled, and the cooling air discharge from the tip corner cooling hole is directed upward so as not to cool the tip surface immediately downstream from the cooling hole. Also, the tip floor cooling hole discharges cooling air straight up so that the layer of cooling air from the upstream hole is pushed up and away from the top surface of the tip to produce inadequate cooling thereof.

U.S. Pat. No. 6,602,502 B2 issued to Liang on Aug. 5, 2003 and entitled AIRFOIL TIP SQUEALER COOLING CONSTRUCTION discloses a blade with a tip floor that is not flat formed by two short tip rails on the pressure side and suction, side, and the pressure side wall adjacent to the tip corner includes one or two film cooling holes directed to discharge cooling air upward toward the tip corner. In this design, the layer of cooling air from the pressure side wall hole or holes flows up and over the pressure side tip rail without touching the tip surface immediately downstream from the pressure side tip rail. Inadequate cooling of the tip floor at this location occurs in this design.

U.S. Pat. No. 5,282,721 issued to Kildea on Feb. 1, 1994 and entitled PASSIVE CLEARANCE SYSTEM FOR TURBINE BLADES shows an earlier design in which the blade tip corner is pointed and slanted toward the oncoming hot gas flow, and one cooling hole located on the pressure side wall and just below the tip corner to discharge cooling air toward the oncoming hot gas flow. This design is intended to push away the hot gas flow from the gap. In a second embodiment, a second cooling hole discharges cooling, air from the tip crown surface at an angle toward, the oncoming hot gas flow to also block the hot gas from entering the gap. A film layer of cooling air is not developed onto the surface of the tip crown or floor at the pressure side corner.

This problem associated with turbine airfoil tip edge cooling can be minimized by incorporation of anew and effective blade tip cooling geometry design of the present invention into the prior art airfoil tip section cooling design.

BRIEF SUMMARY OF THE. INVENTION

It is an object of the present invention to provide for a turbine blade with improved tip corner cooling over the cited prior art.

It is another object of the present invention to provide for a turbine blade with a tip corner that has a lower metal temperature than the prior art designs.

The turbine blade includes a tip region with a single tip rail along the suction side and a plurality of discrete curved diffusion cooling holes that discharge film cooling air upstream of the tip rail from a top edge of the pressure side edge and onto the top side of the blade tip. A layer of film cooling air flows over the front edge of the tip corner and then over the tip corner while a second layer of film cooling air is discharged downstream to provide film cooling of the tip floor where the first layer does not. A TBC is applied along the pressure side and suction side walls of the blade and extends along the backside of the suction side tip rail. The entrance for each of the curved diffusion holes is a metering hole that opens into the cooling supply cavity at a normal direction to the cavity surface. These inlet holes meter the cooling air flow into, the diffusion portion of the curved holes.

DETAILED DESCRIPTION OF THE INVENTION

Figure 5:
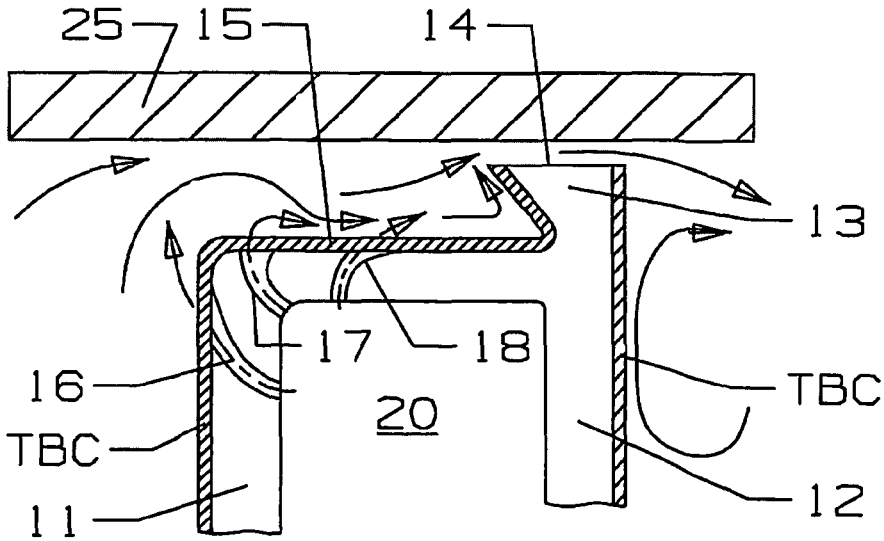
FIG. 5 shows a cross section view of the blade tip of the present invention with the single suction side tip rail and curved diffusion holes.

The turbine blade with the tip cooling arrangement of the present invention is shown in FIG. 5 with a gap formed between the blade tip and the blade outer air seal 25 (BOAS). The blade includes a pressure side wall 11 and a suction side wall 12 each with a TBC applied. The blade also includes a suction side tip rail 13 with an inner side slanted in the upstream flow direction, and a tip crown 14 that forms a small gap with the BOAS 25. A blade tip floor 15 encloses the blade to form the outer surface of the blade tip and also has the TBC applied. The forward edge of the pressure side wall 11 and tip floor 15 is curved in this particular embodiment.

Figure 6:
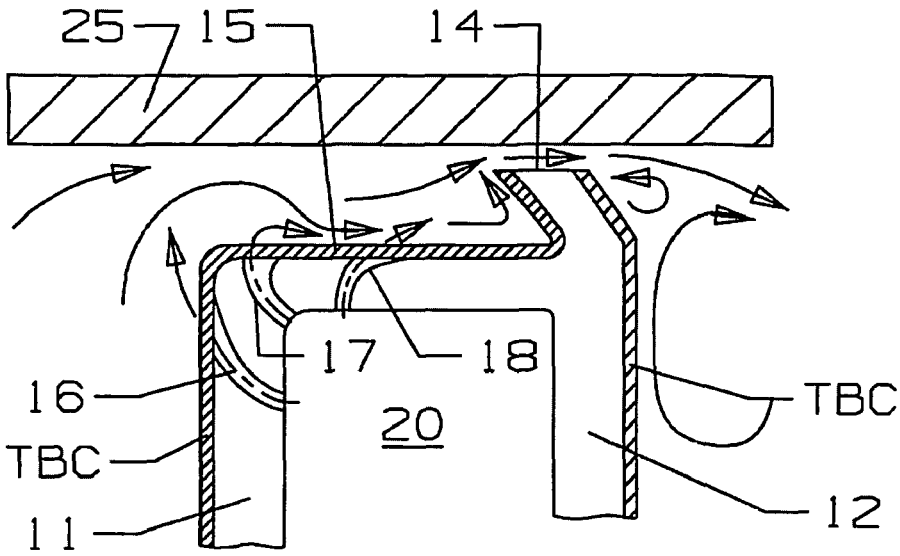
FIG. 6 shows a cross section view of a second embodiment of the blade tip of the present invention.

Three curved diffusion holes are arranged in tandem to discharge cooling air from the cooling supply cavity 20 (or other internal cooling air supply channel) and out onto the surface of the blade tip. A first curved diffusion hole 16 is located on the pressure side wall, a second curved diffusion hole 17 located at a corner of the cooling supply cavity 20, and a third curved diffusion hole 18 discharges cooling air onto the tip floor 15. Each of the curved diffusion holes have an inlet that opens into the cooling supply cavity 20 in which the inlet open is at a normal or 90 degree orientation to the surface of the cavity 20. Also, the inlet for each of the curved diffusion holes functions as a metering hole for the diffusion portion located downstream in the cooling air flow direction to meter the flow from the cavity and into the diffusion hole. The diffusion portion of each hole includes a progressively increasing hole height as seen in FIG. 5. The width of each hole (would be in the direction normal to the paper in the figure) does not change. The first, curved diffusion hole 16 opens onto the pressure side wall surface just below the tip corner, the second, curved diffusion hole 17 opens onto the tip cap just downstream from the tip corner (in other embodiments it can open onto the corner), and the third curved diffusion hole 18 opens onto the tip cap surface at about the midpoint from the tip corner to the tip rail 13. Also, the pressure side tip corner can be square, slightly rounded as shown in FIGS. 5 and 6, more rounded than shown, or the corner can be chamfered.

The discrete curved diffusion film cooling holes include two different radiuses of curvatures. A smaller radius of curvature is used in the inboard surface of the film cooling hole. The opening of the holes onto the surface of the airfoil or tip floor is a slot because of the diffusion shape and angle of the hole to the surface. When referring to a hole, this disclosure also means a slot. A larger radius of curvature is used in the out board surface of the film hole. As a result of this construction, the pressure side peripheral film cooling hole comprises a constant diameter section at the entrance region, normal to the inner wall of the cavity, which provides cooling flow metering capability, and a one dimensional curved diffusion section with a shallow expansion along the cooling flow direction. A large film hole breakout geometry is achieved. The result is a shallow cooling air injection angle to the tip cap surface and a better film effectiveness level.

Figure 1:
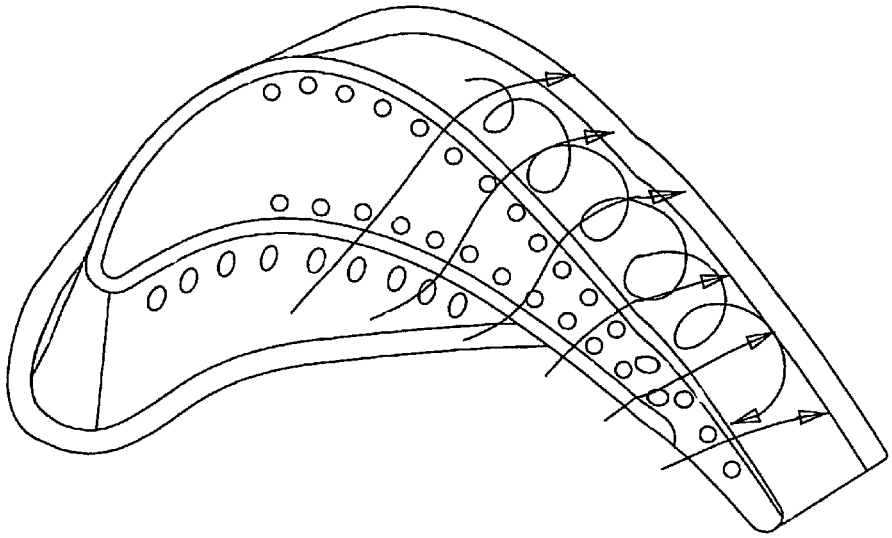
Fig 1 Prior Art
FIG. 1 shows the prior art squealer tip cooling arrangement and the secondary hot gas flow migration around the blade tip section.
Figure 2:
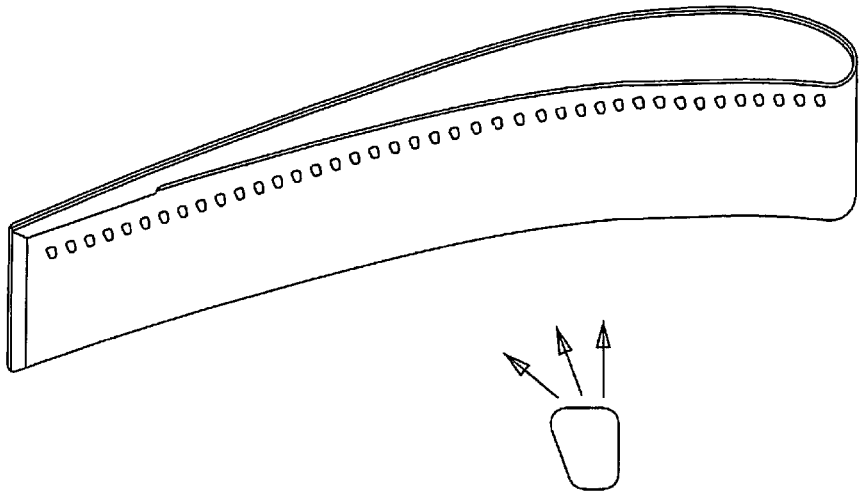
Fig 2 Prior art
FIG. 2 shows a profile view of the pressure side of the prior art blade tip of FIG. 1.
Figure 3:
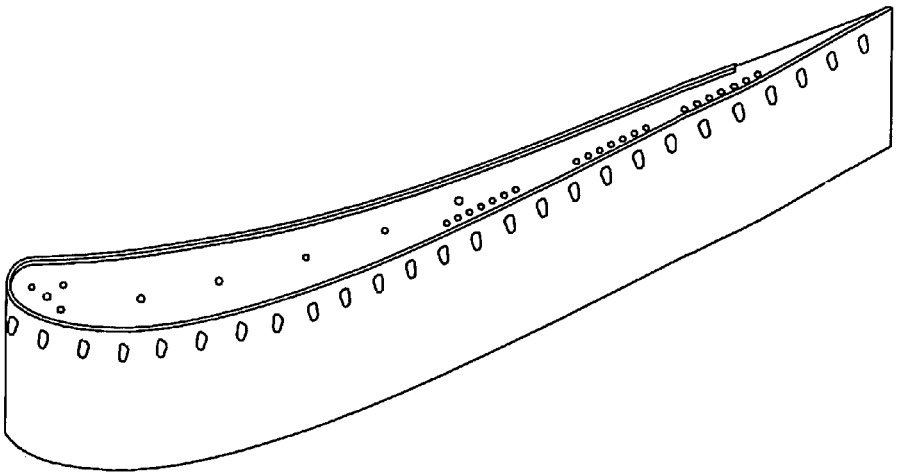
Fig 3 Prior Art
FIG. 3 shows a profile view of the suction side of the prior art blade tip of FIG. 1.
Figure 4:
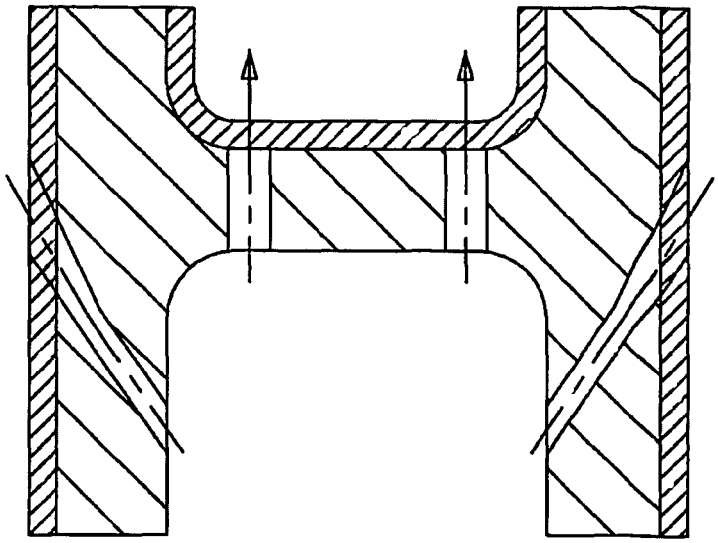
Fig 4 Prior art
FIG. 4 shows a profile view of the blade tip cooling design of the prior art.

In operation, cooling air is fed into the curved diffusion hole from the blade cooling supply cavity and then flows through the curved cooling hole to provide cooling for the blade pressure side tip corner. Since the cooling holes are curved in shape, the cooling air has to change its momentum while flowing through the cooling hole which then generates a high rate of internal heat transfer coefficient within the curved hole. Also, the curved cooling hole will discharge the cooling air onto the external blade surface much closer to the airfoil wall than with the straight cooling hole of the FIG. 4 prior art. In addition, due to the pressure gradient across the airfoil from the pressure side to the suction side, the secondary flow near the pressure side surface is migrated from the lower blade span upward across the blade end tip.

On the pressure side corner of the airfoil location, the secondary leakage flow entering the squealer floor acts like a developing flow at low heat transfer rate. Since the floor of the squealer tip is lower from the blade conical flow path, the secondary leakage, flow will be accelerated across the blade tip. This enables the injected film cooling flow from the blade pressure side peripheral, as well as injected air from the blade pressure side corner and the tip cap floor to establish a well formed film sub-boundary layer over the blade tip surface and thus provides a good film cooling for the floor of the blade tip section.

With a lower blade tip floor, the film cooling flow is injected from the airfoil pressure side wall and from the pressure side tip corner will push the near-wall secondary leakage flow outward and against the on-coming stream-wise leakage flow first. The combination of the blade pressure side film flow and corner film flow and the film cooling flow injection from the blade tip floor is then deflected upward by the suction side tip rail forward curved surface prior to entering the suction side tip rail channel.

A second embodiment of the blade tip, is shown in FIG. 6 where the suction side tip rail includes a backside that slants forward and parallel to the inner side wall that forms the tip rail. The slanted back side of the tip rail allows for the formation of a counter rotating vortex flow as seen in the figure by the rounded arrow. This counter flowing vortex flows against the leakage through the tip crown to reduce the leakage flow across the blade tip.

The process for cooling the tip floor of the turbine blade includes the steps of supplying pressurized cooling air to one or more cooling supply cavities formed between the pressure and suction side walls of the blade, metering the cooling air into the curved cooling passages formed within the wall and floor of the blade, diffusing, the metered cooling air through a diffuser that forms a slot opening onto the surfaces of the wall and the tip floor, discharging the first film layer from the pressure side wall at a location just below the tip corner to that the first-layer flows up and over the tip corner, discharging the second film layer from the tip corner so that the second film layer provides film cooling for the tip floor where the first film layer does not make contact with, discharging the third film layer onto the tip floor from a location downstream from the second film layer and upstream from the tip rail on the suction side wall, and merging the three film layers prior to passing the cooling air through the tip gap formed between the tip crown and the BOAS.

I claim the following:

1. A turbine blade for use in a gas turbine engine, the blade comprising:

A blade tip having a single tip rail on the suction side of the blade tip and no tip rail on the pressure side of the tip;

A tip floor extending from a front corner of the blade tip to the suction side tip rail;

A cooling supply cavity formed between a pressure side wall and a suction side wall of the blade;

A first diffusion cooling hole connected to the cooling supply cavity and opening onto the pressure side wall just below the tip corner, the opening oriented to discharge a first layer of film cooling air upward toward the tip corner; and, A second diffusion cooling hole connected to the cooling supply cavity and opening onto the tip corner on the tip floor side of the tip corner, the second diffusion cooling hole being curved toward the tip rail so as to discharge a second layer of film cooling air onto a surface of the tip floor not covered by the first layer of film cooling air.

2. The turbine blade of claim 1, and further comprising:

The tip corner is slightly rounded.

3. The turbine blade of claim 1, and further comprising:

The tip corner is chamfered.

4. The turbine blade of claim 1, and further comprising:

A third diffusion cooling hole connected to the cooling supply cavity and opening onto the tip floor between the tip corner and the tip rail, the third diffusion cooling hole being oriented to discharge the cooling air toward the tip rail.

5. The turbine blade of claim 4, and further comprising:

The first and third diffusion holes are curved in a direction toward the tip rail.

6. The turbine blade of claim 5, and further comprising:

The third diffusion hole opens onto the lip floor at a position midway from the tip corner to the tip rail.

7. The turbine blade of claim 1, and further comprising:

The tip rail includes a forward side that slants toward the pressure side wall of the blade.

8. The turbine blade of claim 7, and further comprising:

The tip rail includes an aft side that slants toward the pressure side wall and is parallel to the front side of the tip rail.

9. The turbine blade of claim 1, and further comprising:

A TBC applied to the pressure side wall of the blade, the tip corner, the tip floor, and the front side wall of the tip rail.

10. The turbine blade of claim 1, and further comprising:

The diffusion holes include a metering hole on the inlet and a diffusion slot on the exit so that cooling air entering the hole is metered and then diffused on exiting the hole.

11. The turbine blade of claim 10, and further comprising:

Each of the metering holes open into the cooling supply cavity normal to the cavity wall surface.

12. The turbine blade of claim 1, and further comprising:

The tip corner is a chamfered corner; and,

The second diffusion hole opens onto the chamfered corner surface.

13. The turbine blade of claim 1, and further comprising:

The tip corner is a rounded corner; and,

The second diffusion hole opens onto the tip floor just downstream from the rounded corner.

14. The turbine blade of claim 1, and further comprising:

The diffusion holes have a zero diffusion on the chordwise length sides and a positive diffusion on the spanwise length sides of the holes.

15. The turbine blade of claim 1, and further comprising:

The blade tip includes a row of first and second curved diffusion holes extending along the pressure side wall and tip corner of the blade from ear the leading edge to near the trailing edge.

16. The turbine blade of claim 1, and further comprising:

The first and second diffusion holes are curved upward toward the tip rail; and, The bottom side of each curved hole has a, radius of curvature less than the top side of each hole.

* * * * *